US009004265B2

(12) United States Patent
Aldred et al.

(10) Patent No.: US 9,004,265 B2
(45) Date of Patent: Apr. 14, 2015

(54) METHODS FOR RESTRICTING BACKFLOW OF SOLIDS IN A PUMP ASSEMBLY

(75) Inventors: Derek Leslie Aldred, Granada Hills, CA (US); Jeffrey Allen Rader, Arleta, CA (US)

(73) Assignee: General Electric Company, Schenectady, NY (US)

( * ) Notice: Subject to any disclaimer, the term of this patent is extended or adjusted under 35 U.S.C. 154(b) by 542 days.

(21) Appl. No.: 13/449,639

(22) Filed: Apr. 18, 2012

(65) Prior Publication Data

US 2013/0276889 A1 Oct. 24, 2013

(51) Int. Cl.

| | |
|---|---|
| ***B65G 31/04*** | (2006.01) |
| ***F04C 2/00*** | (2006.01) |
| ***F04C 13/00*** | (2006.01) |
| ***F04C 14/24*** | (2006.01) |

(52) U.S. Cl.

CPC . *F04C 13/00* (2013.01); *F04C 2/00* (2013.01); *F04C 14/24* (2013.01); *F04C 2240/811* (2013.01); *F04C 2270/40* (2013.01)

(58) Field of Classification Search

CPC ..... B65G 31/04
USPC ..... 415/126, 127; 406/99; 198/642
See application file for complete search history.

(56) References Cited

U.S. PATENT DOCUMENTS

| | | | | |
|---|---|---|---|---|
| 4,516,674 | A | 5/1985 | Firth | |
| 4,988,239 | A | 1/1991 | Firth | |
| 5,051,041 | A | 9/1991 | Firth | |
| 5,355,993 | A | 10/1994 | Hay | |
| 5,381,886 | A | 1/1995 | Hay | |
| 5,402,876 | A | 4/1995 | Hay | |
| 5,485,909 | A | 1/1996 | Hay | |
| 5,497,873 | A | 3/1996 | Hay | |
| 5,551,553 | A | 9/1996 | Hay | |
| 5,657,704 | A | 8/1997 | Schueler | |
| 6,213,289 | B1 | 4/2001 | Hay et al. | |
| 6,832,887 | B2 | 12/2004 | Baer et al. | |
| 7,632,381 | B2 | 12/2009 | Lah | |
| 8,006,827 | B2 | 8/2011 | Aldred et al. | |
| 8,061,509 | B2 * | 11/2011 | Lau | 198/617 |
| 8,496,412 | B2 * | 7/2013 | Livingood et al. | 406/73 |

* cited by examiner

*Primary Examiner* — Ninh H Nguyen

(74) *Attorney, Agent, or Firm* — Armstrong Teasdale LLP

(57) ABSTRACT

A pump assembly includes a rotating component and a stationary component coupled to the rotating component such that the stationary component substantially circumscribes at least a portion of the rotating component. A high pressure outlet extends at least partially through the rotating and stationary components. An inlet is positioned a predefined distance from the high pressure outlet. The inlet extends at least partially through the rotating and stationary components. A solid fuel flow is channeled from the inlet to the outlet as the rotating component rotates. A flow control member is coupled to the rotating and stationary components in a first predefined position. The flow control member is selectively moveable from the first predefined position to a second predefined position to form a seal within the pump assembly such that the solid fuel flow and a fluid flow are substantially restricted from being channeled back into the inlet.

20 Claims, 5 Drawing Sheets

METHODS FOR RESTRICTING BACKFLOW OF SOLIDS IN A PUMP ASSEMBLY

BACKGROUND OF THE INVENTION

The field of the invention relates generally to systems that include solid feed, such as particulate matter, and, more particularly, to a pump assembly that may be used in such systems to substantially restrict backflow within the system.

At least some known systems, such as, but not limited to, dry feed systems and gasification systems, may channel or transport fluids and/or a solid feed, such as particulate matter. For example, gasification systems, such as integrated gasification combined-cycle (IGCC) plants, include a fuel and particulate supply system that is coupled upstream from a gasifier for channeling fuel and particulates to the gasifier. More specifically, in such systems, solid fuel, such as coal, may be channeled to the gasifier, wherein syngas may be generated.

The solid fuel may be channeled to the gasifier using a feed system that includes a solid feed pump that transports the solid fuel along a moving path from an inlet to an outlet. At least some known inlet systems for the solid feed pump are contained within a relatively large pressure vessel with an isolating valve positioned about the vessel. The valve is used to restrict any backflow of the solid fuel. In order to effectively restrict the backflow of the solid fuel, it is necessary for the valve to be large enough to match the inlet pipe and it is necessary for the valve to be pressure rated. Moreover, the pressure vessel needs to be rated for the pump outlet pressure. Such pressure vessels are relatively large and relatively heavy, and such pressure vessels may require additional structure to support the weight. Accordingly, such requisites for the inlet system can be costly. Further, the inlet system may also incorporate load cells and vibrators that are mounted inside the pressure vessel. Due to the positioning of the cells and the vibrators within the pressure vessel, such components require specialized pass-through assemblies and maintenance of the components may be difficult.

BRIEF DESCRIPTION OF THE INVENTION

In one embodiment, a pump assembly is provided. The pump assembly includes a rotating component and a stationary component coupled to the rotating component such that the stationary component substantially circumscribes at least a portion of the rotating component. A high pressure outlet extends at least partially through the rotating and stationary components. An inlet is positioned a predefined distance from the high pressure outlet. The inlet extends at least partially through the rotating and stationary components. A solid fuel flow is channeled from the inlet to the high pressure outlet as the rotating component rotates. A flow control member is coupled to the rotating and stationary components in a first predefined position. The flow control member is selectively moveable from the first predefined position to a second predefined position to form a seal within the pump assembly such that the solid fuel flow and a fluid flow are substantially restricted from being channeled back into the inlet.

In another embodiment, a system is provided. The system includes a feed injector and a pump assembly coupled to the feed injector. The pump assembly includes a rotating component and a stationary component coupled to the rotating component such that the stationary component substantially circumscribes at least a portion of the rotating component. A high pressure outlet extends at least partially through the rotating and stationary components. An inlet is positioned a predefined distance from the high pressure outlet. The inlet extends at least partially through the rotating and stationary components. A solid fuel flow is channeled from the inlet to the high pressure outlet as said rotating component rotates. A flow control member is coupled to the rotating and stationary components in a first predefined position. The flow control member is selectively moveable from the first predefined position to a second predefined position to form a seal within the pump assembly such that the solid fuel flow and a fluid flow are substantially restricted from being channeled back into the inlet.

In yet another embodiment, a method of restricting a backflow of solids using a pump assembly is provided. The pump assembly is coupled to a feed injector. The pump assembly includes a stationary component coupled to a rotating component such that the stationary component substantially circumscribes at least a portion of the rotating component. A solid fuel flow is channeled from a solid feed source to an inlet that extends at least partially through each of the rotating and stationary components. The rotating portion is rotated such that the solid fuel flow is channeled from the inlet to a high pressure outlet positioned a predefined distance from the inlet, wherein the high pressure outlet extends at least partially through each of the rotating and stationary components. A motion is imparted to a flow control member that is coupled to the rotating and stationary components at a first predefined position to selectively move the flow control member from the first predefined position to a second predefined position to form a seal within the pump assembly such that the solid fuel flow and a fluid flow are substantially restricted from being channeled back into the inlet.

DETAILED DESCRIPTION OF THE INVENTION

The exemplary systems and methods described herein overcome at least some known disadvantages associated with at least some known systems that channel solid feed by providing a pump assembly that provides an inexpensive and efficient solution to preventing the backflow of fluid and particulate flow within such systems. More specifically, the pump assembly includes a rotating component and a stationary component coupled to the rotating component. The pump assembly also includes a high pressure outlet and an inlet that is positioned a predefined distance from the high pressure outlet. A solid fuel flow is channeled from the inlet to the high pressure outlet as the rotating component rotates. The pump assembly also includes a flow control member that selectively moves from a first predefined position to a second predefined position to form a seal within the pump assembly such that the solid fuel flow and a fluid flow are substantially restricted from being channeled back into the inlet. As a result, such systems do not need a large pressure vessel to be used with the pump assembly.

Figure 1:
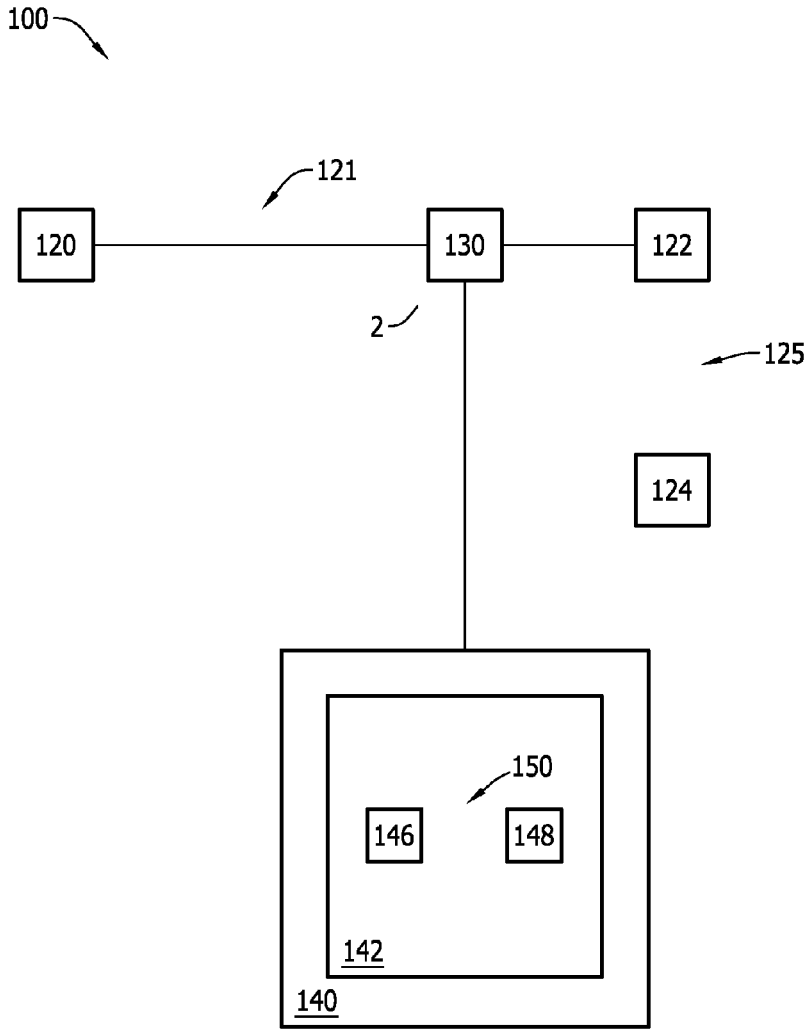
FIG. 1 is a block diagram of a portion of an exemplary system.

FIG. 1 illustrates a portion of an exemplary system 100. More specifically, in the exemplary embodiment, system 100 is a gasification system, such as an integrated gasification combined-cycle (IGCC) plant. Although the exemplary embodiment illustrates a gasification system, the present disclosure is not limited to gasification systems, and one of ordinary skill in the art will appreciate that the current disclosure may be used in connection with any type of system. For example, the present disclosure may also be used in or with pressurized dry feed systems.

In the exemplary embodiment, system 100 includes at least one solid feed source 120 that contains solid feed fuel, such as coal, petroleum coke, biomass, wood-based materials, agricultural wastes, tars, asphalt, or other carbon containing items. A feed injector 122 is coupled to feed source 120 via a conduit 121. In the exemplary embodiment, feed injector 122 is coupled in flow communication with a gasifier 124 via a conduit 125, and gasifier 124 is coupled to gas turbine engine 102 via a conduit 128. System 100 also includes a high pressure pump assembly 130 that is coupled to feed injector 122 and a plurality of transducers or sensors (not shown) that are coupled within, for example, conduits 121 and 125 and/or within pump assembly 130. In the exemplary embodiment, the sensors are configured to detect various operating parameters within system 100, including but not limited to flow pressure, torque, and/or vent flow within, for example, conduits 121 and 125.

The sensors and pump assembly 130 are each coupled to a control system 140. More specifically, in the exemplary embodiment, control system 140 includes a controller 142 that is coupled to the sensors and to pump assembly 130. In the exemplary embodiment, each sensor is configured to transmit a signal corresponding to various operating parameters detected within system 100 to controller 142. Various connections are available between controller 142 and the sensors. Such connections may include, without limitation, an electrical conductor, a low-level serial data connection, such as Recommended Standard (RS) 232 or RS-485, a high-level serial data connection, such as Universal Serial Bus (USB), a field bus, a process field bus (PROFIBUS®), or Institute of Electrical and Electronics Engineers (IEEE®) 1394, a parallel data connection, such as IEEE® 1284 or IEEE® 488, a short-range wireless communication channel such as BLUETOOTH®, and/or a private (e.g., inaccessible outside system) network connection, whether wired or wireless. IEEE is a registered trademark of the Institute of Electrical and Electronics Engineers, Inc., of New York, N.Y. BLUETOOTH is a registered trademark of Bluetooth SIG, Inc. of Kirkland, Wash. PROFIBUS is a registered trademark of Profibus Trade Organization of Scottsdale, Ariz.

Further, in the exemplary embodiment, controller 142 is a real-time controller that includes any suitable processor-based or microprocessor-based system, such as a computer system, that includes microcontrollers, reduced instruction set circuits (RISC), application-specific integrated circuits (ASICs), logic circuits, and/or any other circuit or processor that is capable of executing the functions described herein. In one embodiment, controller 142 may be a microprocessor that includes read-only memory (ROM) and/or random access memory (RAM), such as, for example, a 32 bit microcomputer with 2 Mbit ROM and 64 Kbit RAM. As used herein, the term "real-time" refers to outcomes occurring in a substantially short period of time after a change in the inputs affect the outcome, with the time period being a design parameter that may be selected based on the importance of the outcome and/or the capability of the system processing the inputs to generate the outcome.

In the exemplary embodiment, controller 142 also includes a memory device 146 that stores executable instructions and/or one or more operating parameters representing and/or indicating an operating condition of system 100. More specifically, in the exemplary embodiment, memory device 146 is configured to store the operating parameter and condition values received from the sensors. In the exemplary embodiment, controller 142 also includes a processor 148 that is coupled to memory device 146 via a system bus 150. In one embodiment, processor 148 may include a processing unit, such as, without limitation, an integrated circuit (IC), an application specific integrated circuit (ASIC), a microcomputer, a programmable logic controller (PLC), and/or any other programmable circuit. Alternatively, processor 148 may include multiple processing units (e.g., in a multi-core configuration). The above examples are exemplary only, and thus are not intended to limit in any way the definition and/or meaning of the term "processor." In the exemplary embodiment, processor 148 may be programmed to, for example, compare the detected operating parameter values received from sensors 132 with respective predefined threshold values.

Moreover, in the exemplary embodiment, controller 142 is configured to control an operation of pump assembly 130. In the exemplary embodiment, controller 142 may be coupled to, for example, an actuating member (not shown in FIG. 1) of pump assembly 130. Further, in the exemplary embodiment, for example, processor 148 is programmed to generate one or more control parameters based on the signal(s) received from the sensors, wherein the control parameters are then transmitted to pump assembly 130. For example, in the exemplary embodiment, a control parameter may be to move and/or modulate the actuating member of pump assembly 130. Various connections are available between controller 142 and pump assembly 130. Such connections may include, without limitation, an electrical conductor, a low-level serial data connection, such as Recommended Standard (RS) 232 or RS-485, a high-level serial data connection, such as USB, a field bus, a PROFIBUS®, or Institute of Electrical and Electronics Engineers (IEEE) 1394 (a/k/a FIREWIRE), a parallel data connection, such as IEEE 1284 or IEEE 488, a short-range wireless communication channel such as BLUETOOTH, and/or a private (e.g., inaccessible outside system) network connection, whether wired or wireless.

During operation, the solid fuel flow is channeled from feed source 120 to feed injector 122 via conduit 121. Then the solid fuel flow is channeled to gasifier 124 via conduit 125. When solid fuel flow is channeled from feed source 120 to feed injector 122, the solid fuel flow is channeled into pump assembly 130. As explained in more detail below, the solid fuel flow is channeled from an inlet (not shown in FIG. 1 of pump assembly 130 to an outlet (not shown in FIG. 1) of pump assembly 130 via a flow path (not shown in FIG. 1). As the solid fuel flow is being channeled within system 100, the sensors may detect various operating parameters within system 100 within, for example, conduits 121 and 125, and/or within pump assembly 130. Each sensor then transmits at least one signal representative of the detected operating parameters to control system 140. Control system 140 determines whether the detected operating parameters are suitable for normal operating conditions, such as by comparing the detected parameters with predefined threshold values. For example, control system 140 may compare the detected flow pressure value with a predefined pressure value.

If the detected pressure is substantially lower than, or exceeds, the predefined threshold value, control system 140 transmits a signal representative of a control parameter to pump assembly 130. For example, control system 140 may transmit a signal to substantially block the inlet in pump assembly 130. As explained in more detail below, the actuating member of pump assembly 130 may be moved to facilitate the closing of the inlet. By closing the inlet, pump assembly 130 substantially restricts any backflow of the solid fuel flow. Since pump assembly 130 prevents the backflow of solid fuel flow within system 100, system 100 no longer requires a pressure vessel for the inlet. Moreover, low-ranked coals may be used within system 100 in addition to or in place of high-ranked coals. Accordingly, pump assembly 130 facilitates an inexpensive and efficient operation of system 100.

Figure 2:
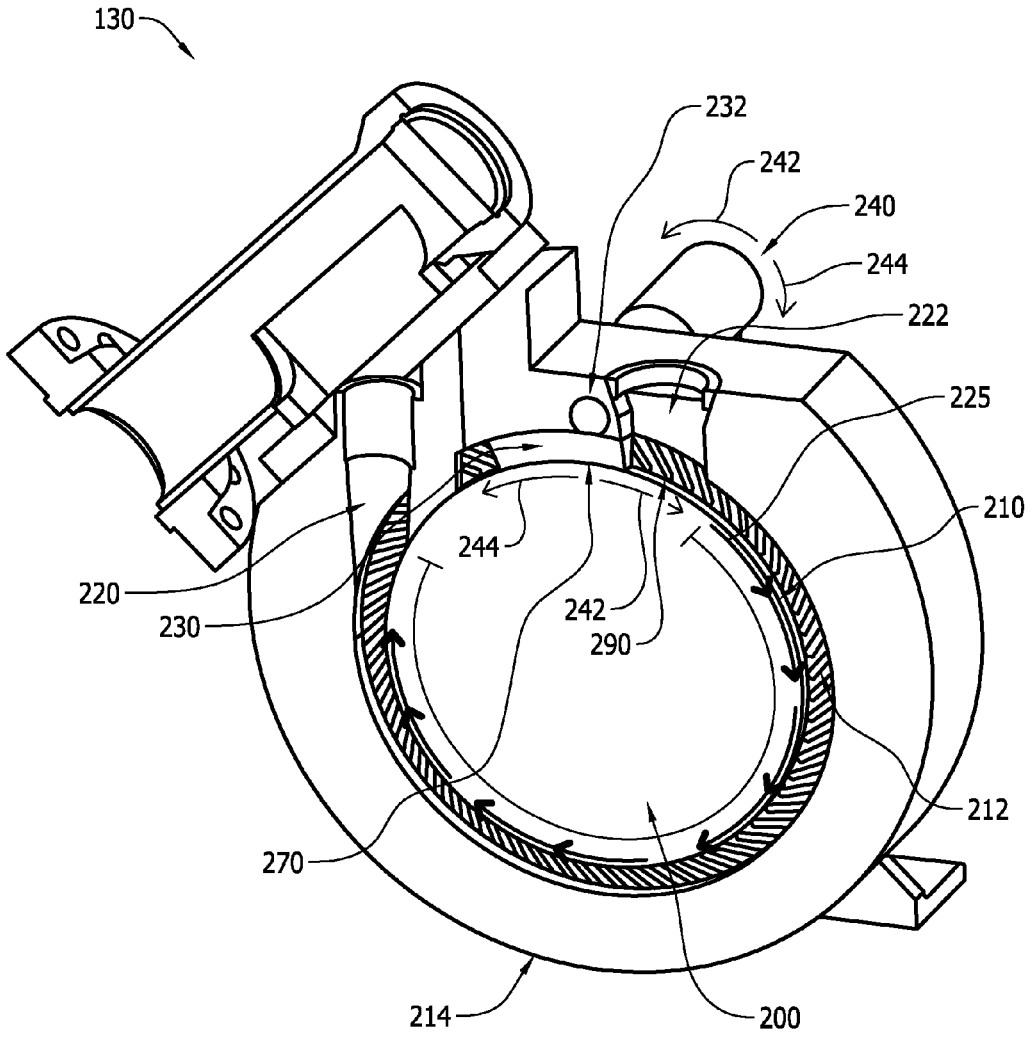
FIG. 2 is a cross-sectional view of an exemplary pump assembly that may be used with the system shown in FIG. 1 and taken along area 2.
Figure 3:
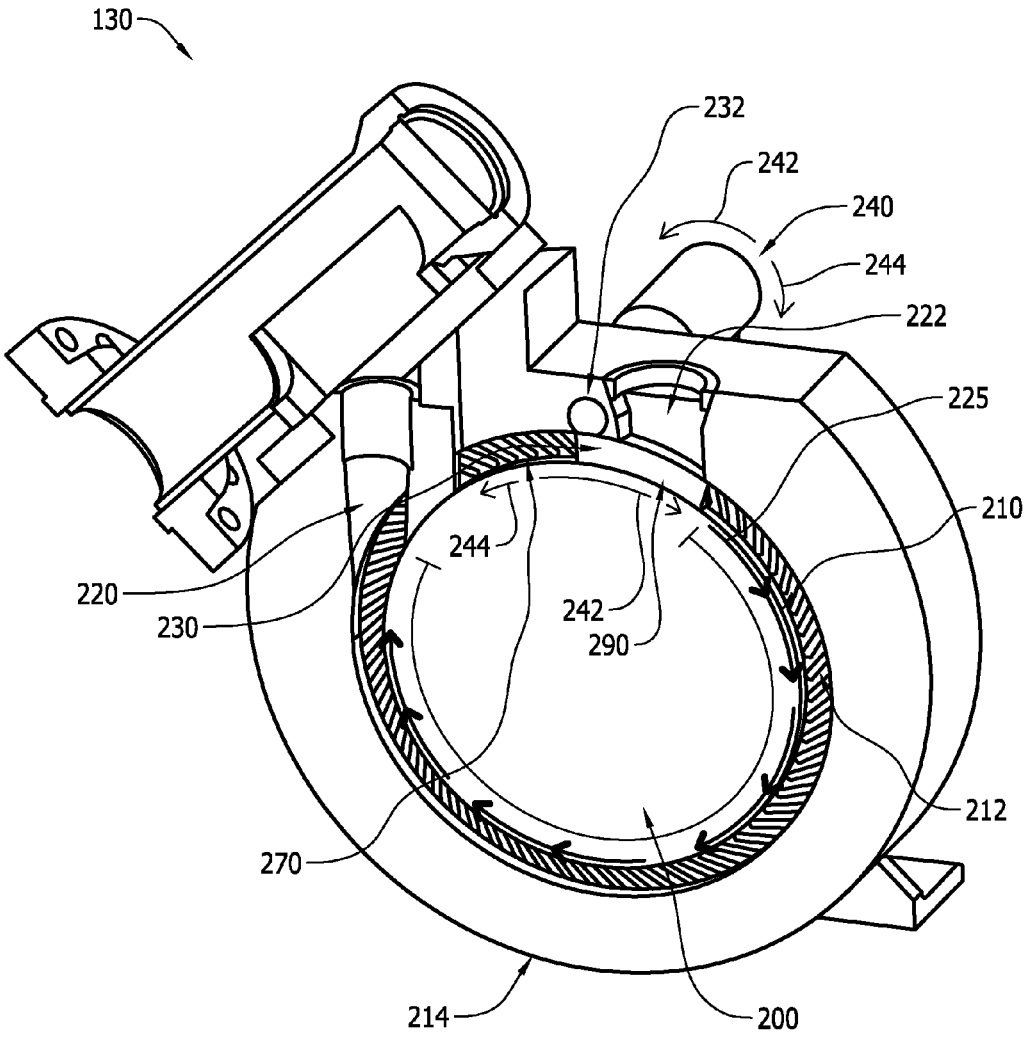
FIG. 3 is a cross-sectional view of the pump assembly shown in FIG. 2 in a closed position.

FIG. 2 is a cross-sectional view of pump assembly 130 and taken along area 2 (shown in FIG. 1) when a flow control member 230 of pump assembly 130 is in an open position. FIG. 3 is a cross-sectional view of pump assembly 130 when flow control member 230 is in a closed position. In the exemplary embodiment, pump assembly 130 includes a rotating component 200 that includes at least one first channel 210 and at least one groove 212 defined therein. More specifically, in the exemplary embodiment, first channel 210 substantially circumscribes at least a portion of rotating component 200, wherein first channel 210 defines a flow path therein, as shown by arrows 225. Grooves 212 each extend substantially radially outwardly from first channel 210 within rotating component 200.

Pump assembly 130 also includes a stationary component 214 coupled to rotating component 200 such that stationary component 214 substantially circumscribes at least a portion of rotating component 200. A high pressure outlet 220 extends at least partially through rotating component 200 and stationary component 214. An inlet 222 is positioned a distance 224 from outlet 220, wherein distance 224 is defined along flow path 225. In the exemplary embodiment, inlet 222 also extends at least partially through rotating component 200 and stationary component 214.

A flow control member 230 is coupled to rotating component 200 and to stationary component 214. More specifically, flow control member 230 is positioned within first channel 210 of rotating component 200. Moreover, flow control member 230 is coupled to stationary component 214 via a coupling device 232 such that flow control member 230 is selectively moveable within first channel 210. More specifically, in the exemplary embodiment, flow control member 230 is coupled to an actuating member 240. Actuating member 240 imparts a motion to flow control member 230 such that flow control member 230 can move within first channel 210. In the exemplary embodiment, actuating member 240 is configured to rotate in either a clockwise or counterclockwise direction, as shown by arrows 242 and 244, respectively, to impart a rotational motion on flow control member 230 such that flow control member 230 moves in either the clockwise or counterclockwise direction 242 and 244, respectively. Alternatively, actuating member 240 may impart any other type of motion that enables pump assembly 130 and/or system 100 (shown in FIG. 1) to function as described herein.

During operation, when solid fuel flow is channeled from feed source 120 (shown in FIG. 1) to feed injector 122 (shown in FIG. 2), the solid fuel flow is channeled into channel 210 when flow control member 230 is in an open position, as shown in FIG. 2. More specifically, flow control member 230 is positioned at a location 270 such that inlet 222 is not blocked and the solid fuel flow may flow freely into channel 210. As rotating component 200 rotates in the clockwise direction 242, solid fuel flow is channeled from inlet 222 to outlet 220 along flow path 225 within channel 210.

As solid fuel flow is being channeled within system 100 and/or within pump assembly 130, sensors (not shown) detect various operating parameters within system 100 and/or within pump assembly 130, such as flow pressure, torque, and/or vent flow within, for example, conduits 121 (shown in FIG. 1) and 125 (shown in FIG. 1), and/or within pump assembly 130. Each sensor then transmits at least one signal representative of the detected operating parameters to control system 140 (shown in FIG. 1). Control system 140 determines whether the detected operating parameters are suitable for normal operating conditions, such as by comparing the detected parameters with predefined threshold values. For example, control system 140 may compare the detected flow pressure value with a predefined pressure value.

If the detected pressure is substantially lower than, or exceeds, the predefined threshold value, control system 140 will transmit a signal representative of a control parameter to pump assembly 130. For example, control system 140 may transmit a signal to substantially block or close inlet 222. More specifically, in response to the signal, actuating member 240 moves in the counterclockwise direction 244. As actuating member 240 moves, flow control member 230 moves within first channel 210 in the clockwise direction 242 from location 270 towards location 290. When flow control member 230 is positioned at location 290, inlet 222 is substantially blocked and flow control member 230 is in the closed position, as shown in FIG. 3. As flow control member 230 substantially blocks inlet 222, a seal is formed within pump assembly 130 such that solid fuel flow and a fluid flow is substantially restricted from being channeled back into inlet 222 when, for example, the solid fuel flow is channeled back in a counterclockwise direction 244 due to blockages and/or pressure abnormalities within pump assembly 130 and/or system 100.

The sensors continue to detect various operating parameters within system 100 and transmit at least one signal representative of the detected operating parameters to control system 140. If the detected pressure is approximately equal to the predefined threshold value, control system 140 will transmit a signal representative of a control parameter to pump assembly 130 such that inlet 222 can be opened again. More specifically, in the exemplary embodiment, actuating member 240 moves in the clockwise direction 242. As actuating member 240 moves, flow control member 230 moves within first channel 210 in the counterclockwise direction 244 from location 290 towards location 270. When flow control member 230 is positioned at location 270, inlet 222 is no longer blocked, and the solid fuel flow is channeled back into pump assembly 130.

Figure 4:
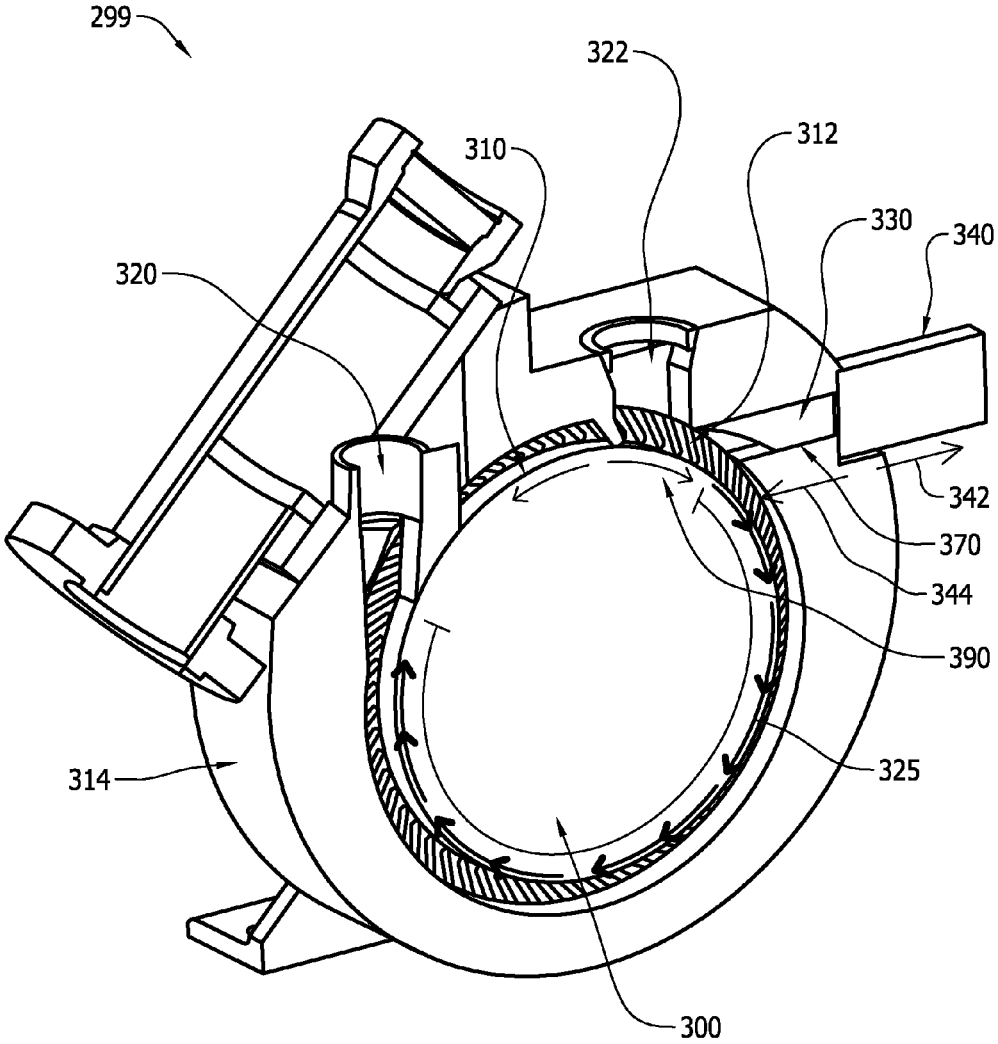
FIG. 4 is a cross-sectional view of an alternative pump assembly that may be used with the system shown in FIG. 1.
Figure 5:
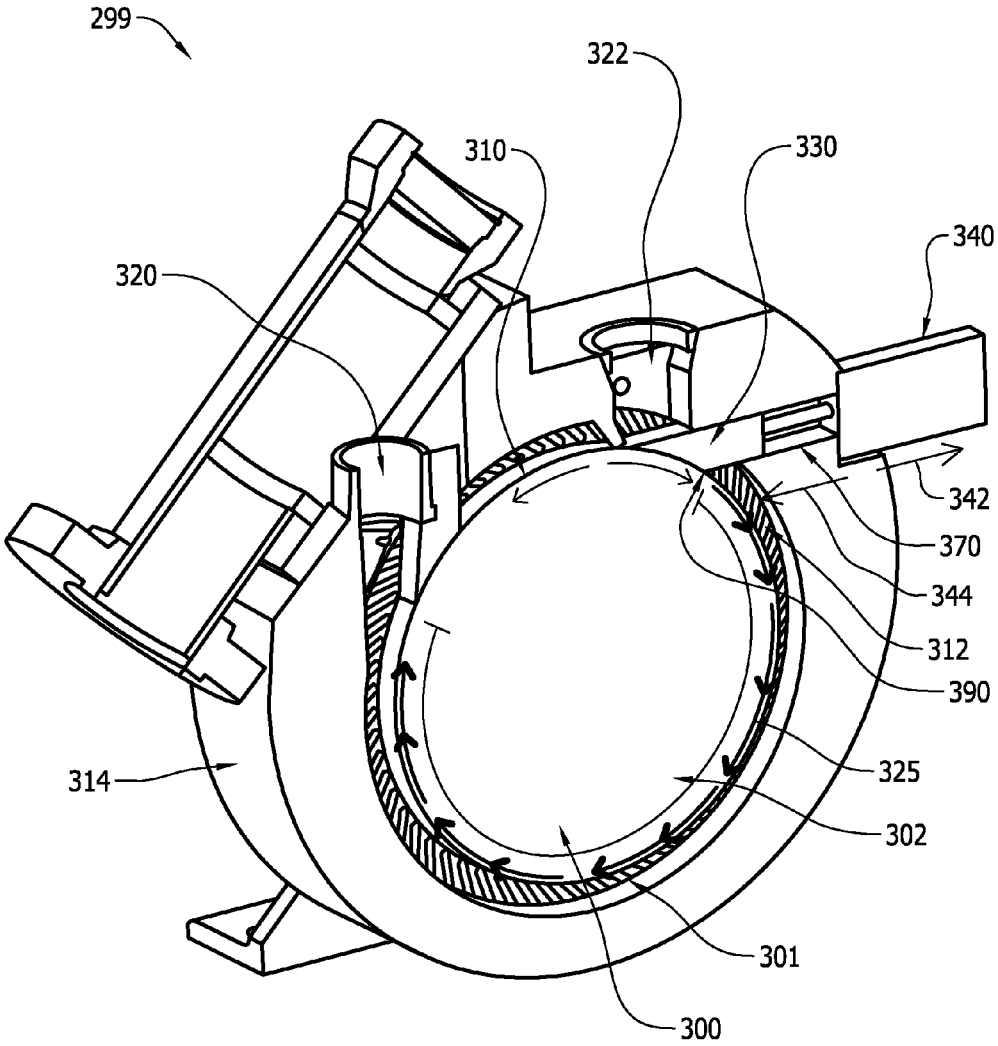
FIG. 5 is a cross-sectional view of the alternative pump assembly shown in FIG. 4 in a closed position.

FIG. 4 is a cross-sectional view of an alternate pump assembly 299, when a flow control member 330 of pump assembly 299 is in an open position, that may be used in system 100 (shown in FIG. 1) in place of pump assembly 130 (shown in FIGS. 1, 2, and 3), and taken along area 2 (shown in FIG. 1). FIG. 5 is a cross-sectional view of pump assembly 299 when flow control member 330 is in a closed position. In the exemplary embodiment, pump assembly 299 includes a rotating component 300 that includes at least one first channel 310 and at least one groove 312 defined within rotating component 300. More specifically, in the exemplary embodiment, rotating component 300 includes one first channel 310 that substantially circumscribes at least a portion of rotating component 300 and first channel 310 defines a flow path for the solid fuel flow, as shown by arrows 325. Grooves 312 each extend substantially radially outwardly from first channel 310.

Pump assembly 299 also includes a stationary component 314 coupled to rotating component 300 such that stationary component 314 substantially circumscribes at least a portion of rotating component 300. A high pressure outlet 320 extends at least partially through rotating component 300 and stationary component 314. An inlet 322 is positioned a distance 324 from outlet 320, wherein distance 324 is defined along flow path 325. In the exemplary embodiment, inlet 322 also extends at least partially through rotating component 300 and stationary component 314.

A flow control member 330 is coupled to rotating component 300 and to stationary component 314. Flow control member 330 is selectively moveable within pump assembly 299. More specifically, in the exemplary embodiment, flow control member 330 is coupled to an actuating member 340, wherein actuating member 340 imparts a motion to flow control member 330 such that flow control member 330 can move. In the exemplary embodiment, actuating member 340 moves linearly in a first direction, as shown by arrow 342, and in a second direction, as shown by arrow 344, to impart a linear motion on flow control member 330 such that flow control member 330 moves in either the first or second direction 342 and 344, respectively. Alternatively, actuating member 340 may impart any other type of motion that enables pump assembly 299 and/or gasification system 100 to function as described herein.

During operation, when solid fuel flow is channeled from feed source 120 (shown in FIG. 1) to feed injector 122 (shown in FIG. 2), the solid fuel flow is channeled into pump assembly when flow control member 330 is in an open position, as shown in FIG. 4. More specifically, flow control member 330 is positioned at a location 370 such that inlet 322 is not blocked and the solid fuel flow can be channeled to inlet 322. As rotating component 300 rotates in the clockwise direction 350, solid fuel flow is channeled from inlet 322 to outlet 320 along flow path 325.

As solid fuel flow is being channeled within system 100 and/or pump assembly 299, sensors (not shown) detect various operating parameters within system 100 and/or pump assembly 299, such as flow pressure, torque, and/or vent flow within, for example, conduits 121 (shown in FIG. 1) and 125 (shown in FIG. 1). Each sensor then transmits at least one signal representative of the detected operating parameters to control system 140 (shown in FIG. 1). Control system 140 determines whether the detected operating parameters are suitable for normal operating conditions, such as by comparing the detected parameters with predefined threshold values. For example, control system 140 may compare the detected flow pressure value with a predefined pressure value.

If the detected pressure is substantially lower than or exceeds the predefined threshold value, control system 140 will transmit a signal representative of a control parameter to pump assembly 299. For example, control system 140 may transmit a signal to substantially block or close inlet 322. More specifically, in the exemplary embodiment, actuating member 340 moves in the first direction 342. As actuating member 340 moves, flow control member 330 moves in the second direction 344 from location 370 towards location 390. When flow control member 330 is positioned at location 390, inlet 322 is substantially blocked and flow control member 330 is in the closed position, as shown in FIG. 5. As flow control member 330 substantially blocks inlet 322, a seal is formed within pump assembly 299 such that solid fuel flow and a fluid flow are substantially restricted from being channeled back into inlet 322 when, for example, the solid fuel flow is channeled back in a counterclockwise direction 352 due to blockages and/or pressure variations within pump assembly 299 and/or system 100.

Sensors 132 continue to detect various operating parameters within system 100 and transmit at least one signal representative of the detected operating parameters to control system 140. If the detected pressure is substantially equal to the predefined threshold value, control system 140 will transmit a signal representative of a control parameter to pump assembly 299 such that inlet 322 can be opened again. More specifically, in the exemplary embodiment, actuating member 340 moves in the second direction 344. As actuating member 340 moves, flow control member 330 moves in the first direction 342 from location 390 towards location 370. When flow control member 330 is positioned at location 370, inlet 322 is no longer blocked, and solid fuel flow is channeled back into pump assembly 299.

As compared to known systems and methods used in systems that channel solid feed, the above-described embodiments provide a pump assembly that provides an inexpensive and efficient solution to preventing the backflow of fluids and particulates within such systems. More specifically, the pump assembly includes a rotating component and a stationary component coupled to the rotating component such that the stationary component substantially circumscribes at least a portion of the rotating component. A high pressure outlet extends at least partially through the rotating and stationary components. An inlet is positioned a predefined distance from the high pressure outlet. The inlet extends at least partially through the rotating and stationary components. A solid fuel flow is channeled from the inlet to the high pressure outlet as said rotating component rotates. A flow control member is coupled to the rotating and stationary components in a first predefined position. The flow control member is selectively moveable from the first predefined position to a second predefined position to form a seal within the pump assembly such that the solid fuel flow and a fluid flow is substantially restricted from being channeled back into the inlet. As a result, such systems do not need a large pressure vessel or pressure containment to be used upstream of the pump assembly.

Exemplary embodiments of apparatus, systems, and methods are described above in detail. The apparatus, systems, and methods are not limited to the specific embodiments described herein, but rather, components of the systems, apparatus, and/or steps of the method may be utilized independently and separately from other components and/or steps described herein. For example, the apparatus may also be used in combination with other systems and methods, and is not limited to practice with only a liquid or beverage industrial system as described herein. Rather, the exemplary embodiment can be implemented and utilized in connection with many other systems.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A pump assembly comprising:

a rotating component;

a stationary component coupled to said rotating component such that said stationary component substantially circumscribes at least a portion of said rotating component;

a high pressure outlet extending at least partially through each of said rotating component and said stationary component;

an inlet positioned a predefined distance from said high pressure outlet, said inlet extends at least partially through each of said rotating component and said stationary component, a solid fuel flow is channeled from said inlet to said high pressure outlet as said rotating component rotates; and a flow control member coupled to said rotating and stationary components in a first predefined position, said flow control member is selectively moveable from the first predefined position to a second predefined position to form a seal within said pump assembly such that the solid fuel flow and a fluid flow are substantially restricted from being channeled back into said inlet.

2. A pump assembly in accordance with claim 1, further comprising an actuating member coupled to said flow control member, said actuating member is configured to impart a motion to said flow control member to move said flow control member from the first predefined position to the second predefined position.

3. A pump assembly in accordance with claim 2, wherein said actuating member is configured to impart one of a rotational motion and a linear motion to said flow control member.

4. A pump assembly in accordance with claim 2, wherein said actuating member is configured to impart a motion to said flow control member after receiving at least one control parameter via at least one signal from a control system.

5. A pump assembly in accordance with claim 1, wherein said rotating component comprises at least one first channel defining a flow path therein.

6. A pump assembly in accordance with claim 5, wherein said flow control member is positioned within said at least one first channel, said flow control member is selectively moveable within said at least one first channel when said flow control member moves from the first predefined position to the second predefined position.

7. A pump assembly in accordance with claim 1, wherein said flow control member is moveable from the first predefined position to the second predefined position to substantially block said inlet.

8. A system comprising:

a feed injector; and a pump assembly coupled to said feed injector, said pump assembly comprising:

a rotating component;

a stationary component coupled to said rotating component such that said stationary component substantially circumscribes at least a portion of said rotating component;

a high pressure outlet extending at least partially through each of said rotating component and said stationary component;

an inlet positioned a predefined distance from said high pressure outlet, said inlet extends at least partially through each of said rotating component and said stationary component, a solid fuel flow is channeled from said inlet to said high pressure outlet as said rotating component rotates; and a flow control member coupled to said rotating and said stationary components in a first predefined position, wherein said flow control member is selectively moveable from the first predefined position to a second predefined position to form a seal within said pump assembly such that the solid fuel flow and a fluid flow are substantially restricted from being channeled back into said inlet.

9. A system in accordance with claim 8, wherein said pump assembly further comprises an actuating member coupled to said flow control member, wherein said actuating member is configured to impart a motion to said flow control member to move said flow control member from the first predefined position to the second predefined position.

10. A system in accordance with claim 9, wherein said actuating member is configured to impart one of a rotational motion and a linear motion to said flow control member.

11. A system in accordance with claim 9, further comprising a control system coupled to said pump assembly, wherein said actuating member is configured to impart a motion to said flow control member after receiving at least one control parameter via at least one signal from said control system.

12. A system in accordance with claim 8, wherein said rotating component comprises at least one first channel defining a flow path therein.

13. A system in accordance with claim 12, wherein said flow control member is positioned within said at least one first channel, said flow control member is selectively moveable within said at least one first channel when said flow control member moves from the first predefined position to the second predefined position.

14. A system in accordance with claim 8, wherein said flow control member is moveable from the first predefined position to the second predefined position to substantially block said inlet.

15. A method of restricting a backflow of solids using a pump assembly, said method comprising:

coupling the pump assembly to a feed injector, wherein the pump assembly includes a stationary component coupled to a rotating component such that the stationary component substantially circumscribes at least a portion of the rotating component;

channeling a solid fuel flow from a solid feed source to an inlet that extends at least partially through each of the rotating and stationary components;

rotating the rotating portion such that the solid fuel flow is channeled from the inlet to a high pressure outlet positioned a predefined distance from the inlet, wherein the high pressure outlet extends at least partially through each of the rotating and stationary components; and imparting a motion to a flow control member coupled to the rotating and stationary components at a first predefined position to selectively move the flow control member from the first predefined position to a second predefined position to form a seal within the pump assembly such that the solid fuel flow and a fluid flow are substantially restricted from being channeled back into the inlet.

16. A method in accordance with claim 15, wherein imparting a motion further comprises imparting a motion by an actuating member that is coupled to the flow control member.

17. A method in accordance with claim 15, wherein imparting a motion further comprises imparting one of a rotational motion and a linear motion to the flow control member.

18. A method in accordance with claim 15, wherein imparting a motion further comprises imparting a motion after receiving at least one control parameter via at least one signal from the control system.

19. A method in accordance with claim 15, wherein coupling the pump assembly further comprises coupling the pump assembly including a rotating component that includes at least one first channel defining a flow path therein.

20. A method in accordance with claim 19, wherein imparting a motion further comprises imparting a motion to a flow control member that is positioned within the at least one channel such that the flow control member is selectively moveable within the at least one first channel when the flow control member moves from the first predefined position to the second predefined position.

* * * * *